US009492798B2

(12) United States Patent
Balash

(10) Patent No.: US 9,492,798 B2
(45) Date of Patent: Nov. 15, 2016

(54) FOAM GENERATION ASSEMBLY AND METHOD FOR MANUFACTURING THE FOAM GENERATION ASSEMBLY

(71) Applicant: Vaughan Industries, Inc., Detroit, MI (US)

(72) Inventor: Andrew Vaughan Balash, St. Clair Shores, MI (US)

(73) Assignee: Vaughan Industries Inc., Detroit, MI (US)

( * ) Notice: Subject to any disclaimer, the term of this patent is extended or adjusted under 35 U.S.C. 154(b) by 791 days.

(21) Appl. No.: 13/905,187

(22) Filed: May 30, 2013

(65) Prior Publication Data

US 2014/0313848 A1 Oct. 23, 2014

Related U.S. Application Data

(60) Provisional application No. 61/813,988, filed on Apr. 19, 2013.

(51) Int. Cl.
*B01F 5/06* (2006.01)
*B01F 3/04* (2006.01)

(52) U.S. Cl.
CPC ..... *B01F 5/0696* (2013.01); *B01F 3/04446* (2013.01)

(58) Field of Classification Search
CPC ..... B01F 5/0696
USPC ..... 366/101, 181.5, 336
See application file for complete search history.

(56) References Cited

U.S. PATENT DOCUMENTS

| | | | | |
|---|---|---|---|---|
| 302,675 | A * | 7/1884 | Suits | C02F 1/42 100/116 |
| 3,018,841 | A * | 1/1962 | Gerlich | F01N 1/081 181/258 |
| 4,366,081 | A | 12/1982 | Hull | |
| 6,371,332 | B1 | 4/2002 | Fox | |
| 7,484,881 | B2 * | 2/2009 | Schulz-Hanke | B01F 1/0027 366/339 |

* cited by examiner

*Primary Examiner* — David Sorkin
(74) *Attorney, Agent, or Firm* — Buckert Patent & Trademark Law Firm, PC; John F. Buckert

(57) ABSTRACT

A foam generation assembly is provided. The assembly includes a tube having first and second end portions and an interior region. The assembly further includes first and second coupling members coupled to the tube, and a first movable retaining member disposed within the interior region proximate to the first coupling member. The assembly further includes a spring disposed within the interior region proximate to the second coupling member. The assembly further includes a second movable retaining member disposed within the interior region adjacent and against the spring, and a plurality of pellets disposed within the interior region between the first and second movable retaining members. The spring compresses the plurality of pellets between the first and second movable retaining members.

18 Claims, 10 Drawing Sheets

FOAM GENERATION ASSEMBLY AND METHOD FOR MANUFACTURING THE FOAM GENERATION ASSEMBLY

CROSS-REFERENCE TO RELATED APPLICATIONS

This application claims priority to U.S. Provisional Patent Application No. 61/813,988 filed on Apr. 19, 2013, the entire contents of which are hereby incorporated by reference herein.

BACKGROUND

A foam generation device utilizing an internal pad to generate turbulence has been utilized. However, the foam generation device can be undesirably clogged with particles which inhibits the flow of liquid through the foam generation device.

Accordingly, the inventor herein has recognized a need for an improved foam generation device that minimizes and/or eliminates the above-mentioned deficiency.

SUMMARY

A foam generation assembly in accordance with an exemplary embodiment is provided. The foam generation assembly includes a tube having a first end portion and a second end portion. The tube further includes an inner surface defining an interior region. The foam generation assembly further includes a first coupling member having a first central aperture extending therethrough. The first coupling member is coupled to the first end portion such that the first central aperture communicates with the interior region. The foam generation assembly further includes a second coupling member having a second central aperture extending therethrough. The second coupling member is coupled to the second end portion such that the second central aperture communicates with the interior region. The foam generation assembly further includes a first movable retaining member being disposed within the interior region proximate to the first coupling member. A diameter of the first movable retaining member is larger than a diameter of the first central aperture of the first coupling member. The diameter of the first movable retaining member is less than a diameter of the interior region such that a gap is formed between the first movable retaining member and the inner surface of the tube. The foam generation assembly further includes a spring that is disposed within the interior region proximate to the second coupling member. The foam generation assembly further includes a second movable retaining member that is disposed within the interior region adjacent and against the spring. A diameter of the second movable retaining member is less than the diameter of the interior region such that a gap is formed between the second movable retaining member and the inner surface of the tube. The foam generation assembly further includes a plurality of pellets that are disposed within the interior region between the first movable retaining member and the second movable retaining member. The spring is disposed between the second movable retaining member and the second coupling member. The spring is configured to compress the plurality of pellets between the first movable retaining member and the second movable retaining member.

A method for manufacturing a foam generation assembly in accordance with another exemplary embodiment is provided. The method includes providing a tube, first and second coupling members, first and second movable retaining members, a plurality of pellets, and a spring. The tube has a first end portion and a second end portion. The tube further includes an inner surface defining an interior region. The first coupling member has a first central aperture extending therethrough. The second coupling member has a second central aperture extending therethrough. The method further includes coupling the first coupling member to the first end portion of the tube such that the first central aperture of the first coupling member communicates with the interior region. The method further includes disposing the first movable retaining member within the interior region proximate to the first coupling portion. A diameter of the first movable retaining member is larger than a diameter of the first central aperture of the first coupling member. The diameter of the first movable retaining member is less than a diameter of the interior region such that a gap is formed between the first movable retaining member and the inner surface of the tube. The method further includes disposing the plurality of pellets within the interior region such that a portion of the plurality of pellets rest on the first movable retaining member. A diameter of each ball of the plurality of pellets is less than a size of the gap formed between the first movable retaining member and the inner surface of the tube. The method further includes disposing the second movable retaining member within the interior region such that the second movable retaining member rests on a portion of the plurality of pellets. A diameter of the second movable retaining member is less than the diameter of the interior region such that a gap is formed between the second movable retaining member and the inner surface of the tube. The method further includes disposing the spring in the interior region of the tube such that the spring rests on the second movable retaining member. The method further includes coupling the second coupling member to the second end portion of the tube such that the second central aperture of the second coupling member communicates with the interior region and the spring is compressed between the second coupling member and the second movable retaining member. The spring is configured to urge the second movable retaining member toward the first movable retaining member such that plurality of pellets are compressed between the first movable retaining member and the second movable retaining member.

DETAILED DESCRIPTION

Figure 1:
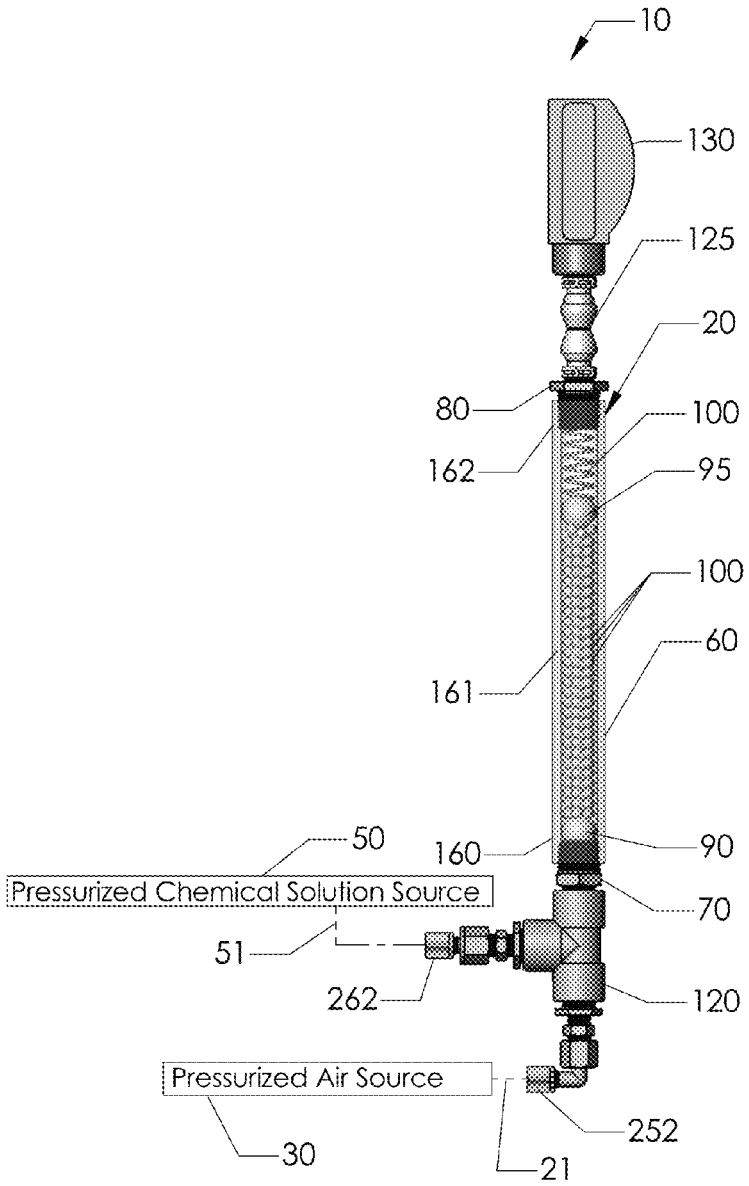
FIG. 1 is a schematic of a vehicle cleaning system having a foam generation assembly in accordance with an exemplary embodiment.
Figure 2:
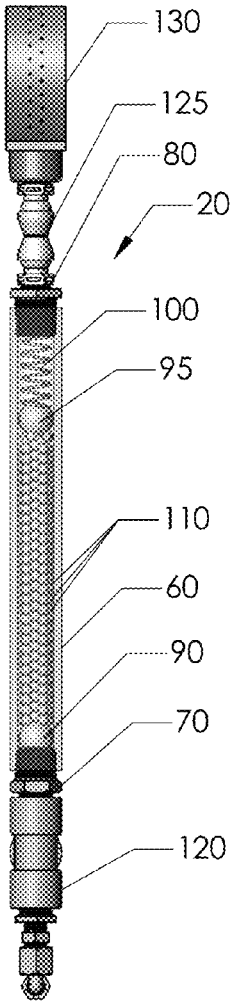
FIG. 2 is a side view of the foam generation assembly of FIG. 1.

Referring to FIGS. 1-5, a vehicle cleaning system 10 that generates a foam 53 (shown in FIG. 4) for cleaning a vehicle is illustrated. The vehicle cleaning system 10 includes a foam generation assembly 20 in accordance with an exemplary embodiment, a pressurized air source 30, and a pressurized chemical solution source 50. An advantage of the foam generation assembly 20 is that the assembly 20 utilizes a plurality of pellets 110 disposed within a tube 60 for generating turbulence in a mixture of air 21, and a chemical solution 51 flowing past the plurality of pellets 110 to generate a foam 53. A further advantage of the foam generation assembly 20 is that the assembly 20 utilizes a spring 100 which allows the plurality of pellets 110 to move into first direction within the tube 60 when the mixture is flowing through the tube 60 such that particles undesirably lodged between at least some of the pellets 110 is released to prevent the particles from inhibiting the flow of the mixture through the tube 60. In other words, the foam generation assembly 20 allows an operator to repeatedly use the assembly 20 without having to clean the interior region or pellets 110 of the assembly 20. For purposes of understanding, the term "foam" used herein refers to an aerated chemical solution or a chemical solution in a foam state.

The pressurized air source 30 is configured to supply the pressurized air 21 into the fitting 252 of a connecting assembly 120 of the foam generation assembly 20 which is subsequently routed through the tube 60.

The pressurized chemical solution source 50 is configured to supply a pressurized chemical solution 51 into the fitting 262 of the connecting assembly 120 of the foam generation assembly 20 which is subsequently routed through the tube 60. In one exemplary embodiment, the pressurized chemical solution 51 is at least one of: a cleaning soap, a cleaning detergent, a polishing wax, and a bleach. In an alternative embodiment, the chemical solution 51 can comprise a pesticide or an insecticide. The pressurized chemical solution 51 can be either in a liquid form, or a granular form mixed with a liquid.

During operation, the foam generation assembly 20 receives a mixture of the air 21 and the chemical solution 51. The mixture flows around the plurality of pellets 110 and the pellets 110 generate a significant amount of turbulence within the mixture in the tube 60 such that the foam 53 is generated within the tube 60. The foam 53 flows through a swivel joint 125 and into the nozzle 130. The nozzle 130 directs the foam 53 outwardly from the nozzle 130.

The foam generation assembly 20 includes a tube 60, a first coupling member 70, a second coupling member 80, a first movable retaining member 90, a second movable retaining member 95, a spring 100, a plurality of pellets 110, a connection assembly 120, a swivel joint member 125, and a nozzle 130.

Referring to FIGS. 1, 2, 4, 7 and 9, the tube 60 includes a first end portion 160, a central body portion 161, and a second end portion 162. The tube 60 further includes an inner surface 164 that defines an interior region 166 therein. The first end portion 160 includes internal threads 168 which threadably receive corresponding external threads 190 of the first coupling member 70. The second end portion 162 includes internal threads 169 which threadably receive corresponding external threads 216 of the second coupling member 80. The interior region 166 is configured to hold the first movable retaining member 90, the second movable retaining member 95, the plurality of pellets 110, and the spring 100 therein. In one exemplary embodiment, the tube 60 is constructed of plastic. Of course, in an alternative embodiment, the tube 60 could be constructed another material such as stainless steel, steel, aluminum, or copper for example.

Figure 6:
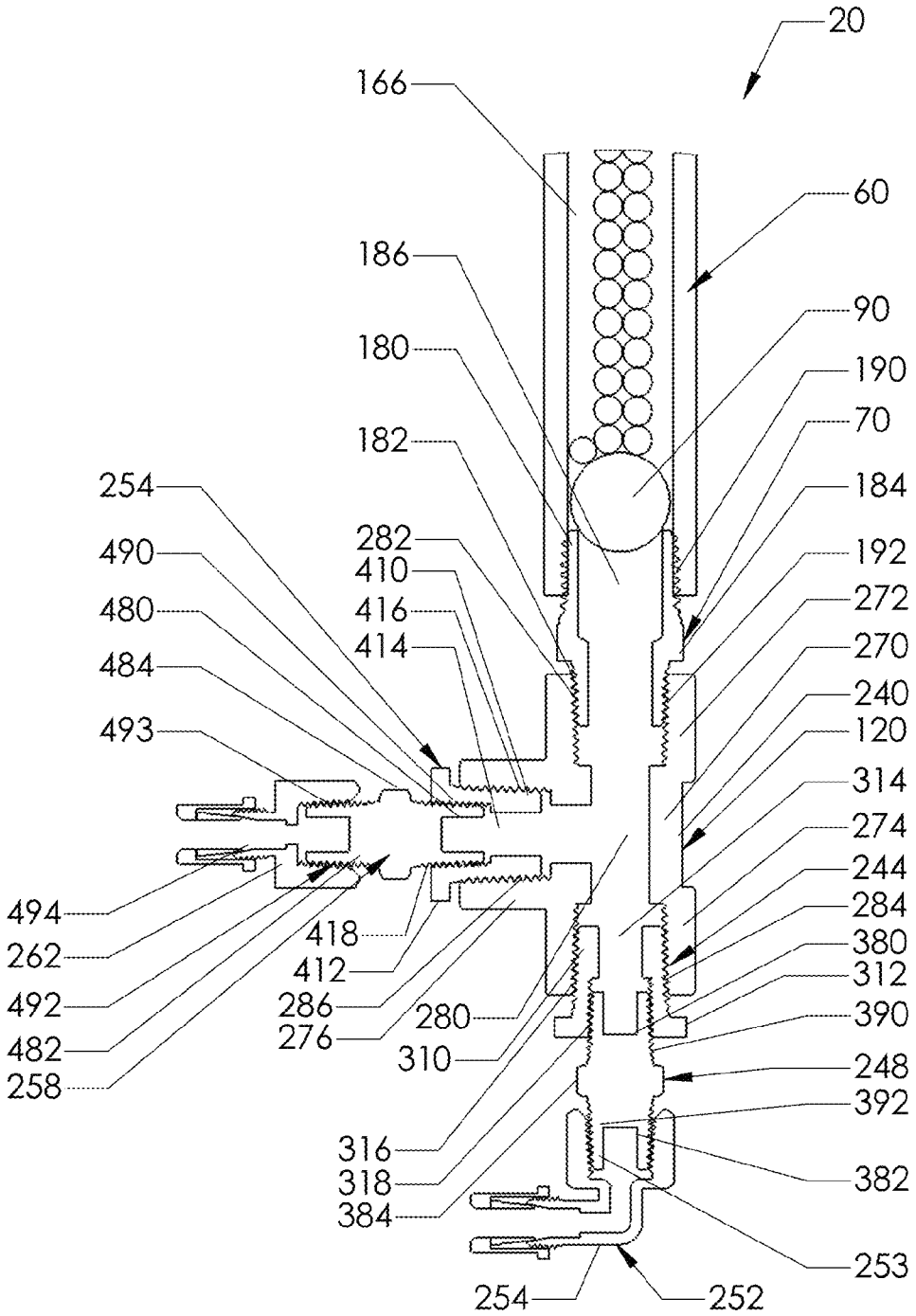
FIG. 6 is an enlarged cross-sectional view of a lower portion of the foam generation assembly of FIG. 4.

Referring to FIGS. 1, 4, 6, 7, and 10, the first coupling member 70 is configured to couple the tube 60 to the connection assembly 120. The first coupling member 70 is further configured to receive a mixture of the air 21 and the chemical solution 51 from the connection assembly 120 and to route the mixture into the tube 60. Referring to FIG. 6, the first coupling member 70 includes a first end portion 180, a second end portion 182, and a central body portion 184. The central body portion 184 is coupled to and disposed between the first end portion 180 and the second end portion 182. The first coupling member 70 includes a central aperture 186 extending through the first end portion 180, the second end portion 182, and the central body portion 184. The first end portion 180 includes external threads 190 configured to be threadably received within the internal threads 168 (shown in FIG. 7) of the tube 60. When the first coupling member 70 is coupled to the tube 60, the central aperture 186 fluidly communicates with the interior region 166 of the tube 60. In one exemplary embodiment, the first coupling member 70 is constructed of plastic. Of course, in an alternative embodiment, the first coupling member 70 could be constructed of another material such as such as stainless steel, steel, aluminum, or copper for example.

Referring to FIGS. 4, 8, 9 and 10, the second coupling member 80 is configured to couple the tube 60 to the swivel joint member 125. The second coupling member 80 is further configured to receive the foam 53 (shown in FIG. 4) from the tube 60 and to route the foam 53 to an interior region of the swivel joint member 125. The second coupling member 80 includes an end portion 210 and a body portion 212. The second coupling member 80 further includes a central aperture 214 extending through the end portion 210 and the body portion 212. The end portion 210 includes external threads 216 configured to be threadably received within the internal threads 169 (shown in FIG. 9) of the tube 60. When the second coupling member 80 is coupled to the tube 60, the central aperture 214 fluidly communicates with the interior region 166 of the tube 60. In one exemplary embodiment, the second coupling member 80 is constructed of plastic. Of course, in an alternative embodiment, the second coupling member 80 could be constructed of another material such as such as stainless steel, steel, aluminum, or copper for example.

Referring to FIGS. 1, 2, 4 and 7, the first movable retaining member 90 is disposed within the interior region 166 of the tube 60 proximate to the first coupling member 70. A diameter D1 of the first movable retaining member 90 is larger than a diameter D4 of the first central aperture 186 of the first coupling member 70. The diameter D1 of the first movable retaining member 90 is less than a diameter D2 of the interior region 166 such that a gap G1 is formed between the first movable retaining member 90 and the inner surface 164 of the tube 60 to allow a mixture of the air 21 and the chemical solution 51 to flow through the gap G1. In the illustrated embodiment, the first movable retaining member 90 is substantially spherical shaped. However, in an alternative embodiment, the first movable retaining member 90 could have another shape such as a cylindrical shape or have a rectangular cross-sectional shape for example. In one exemplary embodiment, the first movable retaining member 90 is constructed of plastic. However, in an alternative embodiment, the first movable retaining member 90 could be constructed of another material such as rubber, ceramic, steel, stainless steel, aluminum, or copper for example.

Figure 7:
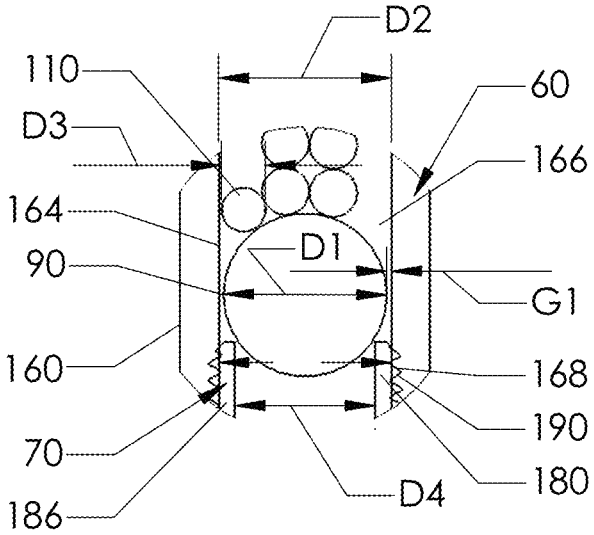
FIG. 7 is an enlarged cross-sectional view of a portion of the lower portion of the foam generation assembly of FIG. 6.
Figure 9:
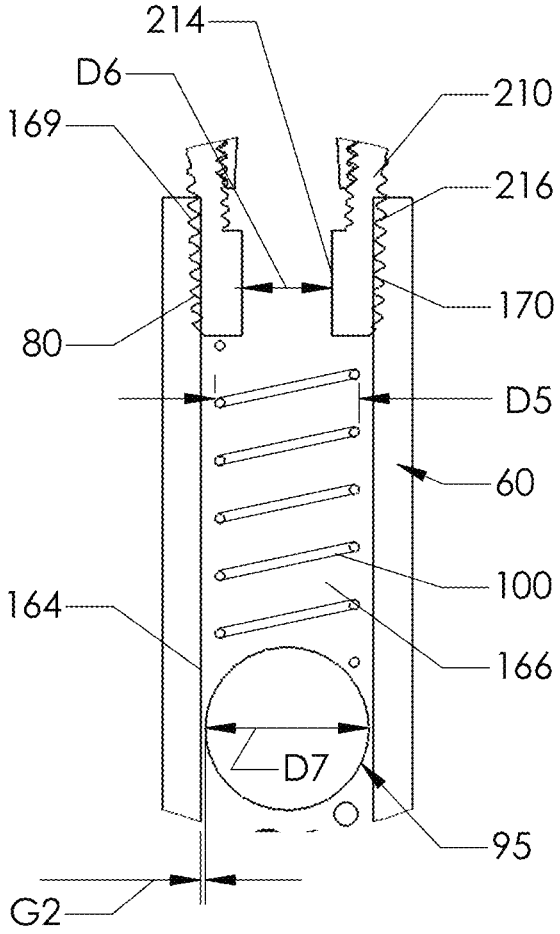
FIG. 9 is an enlarged cross-sectional view of a portion of the upper portion of the foam generation assembly of FIG. 8.

Referring to FIG. 7, when the mixture of the air 21 and the chemical solution 51 does not contact the first movable retaining member 90, the spring 100 indirectly biases the first movable retaining member 90 against the first coupling member 70 such that the member 90 closes off the central aperture 186 of the first coupling member 70. Alternately, referring to FIG. 4, when the pressurized mixture of the air 21 and the chemical solution 51 contacts the first movable retaining member 90, the pressurized mixture overcomes the spring force of the spring 100 and the member 90 moves away from the first coupling member 70 such that the mixture flows through the central aperture 186 and into the interior region 166 of the tube 60. Further, the pressurized mixture flows past the gap G1 formed between the member 90 and the inner surface 164 of the tube 60.

Referring to FIGS. 1, 2, 4, 9 and 10, the spring 100 is disposed within the interior region 166 the tube 60 proximate to and against the second coupling member 80. The spring 100 has an outer diameter D5 greater than an inner diameter D6 of the central aperture 214 of the second coupling member 80. The spring 100 is configured to bias the second movable retaining member 95 in a second direction towards the first movable retaining member 60 such that the plurality of pellets 110 are compressed and held between the first movable retaining member 90 and the second movable retaining member 95. In one exemplary embodiment, spring 100 is constructed of stainless steel. Of course, in an alternative embodiment, the spring 100 could be constructed of another material such as hastelloy, plastic, steel, or copper for example.

Referring to FIGS. 1, 2, 4 and 9, the second movable retaining member 95 is disposed within the interior region 166 of the tube 60 adjacent to and against an end of the spring 100. A diameter D7 of the second movable retaining member 95 is less than a diameter D2 (shown in FIG. 7) of the interior region 166 such that a gap G2 is formed between the second movable retaining member 95 and the inner surface 164 of the tube 60 to allow the foam 53 to flow through the gap G2. In the illustrated embodiment, the second movable retaining member 95 is substantially spherical shaped. However, in an alternative embodiment, the second movable retaining member 95 could have another shape such as a cylindrical shape or have a rectangular cross-sectional shape for example. In one exemplary embodiment, the second movable retaining member 95 is constructed of plastic. However, in an alternative embodiment, the second movable retaining member 95 could be constructed of another material such as rubber, ceramic, steel, stainless steel, aluminum, or copper for example.

Referring to FIGS. 1, 2, 4 and 7, the plurality of pellets 110 are disposed within the interior region 166 of the tube 60 between the first movable retaining member 90 and the second movable retaining member 95. Further, the plurality of pellets 110 substantially fill a portion of the interior region 166 between the first movable retaining member 90 and the second movable retaining member 95. In one exemplary embodiment, at least a portion of the plurality of pellets 110 each have a substantially spherical shape. However, in an alternative embodiment, at least a portion of the plurality pellets 110 could have a substantially cylindrical shape or a substantially oval cross-sectional shape. Further, in another alternative embodiment, the plurality of pellets 110 could have other shapes depending upon an amount of desired turbulence in the mixture flowing through the tube 60 of the foam generation assembly 20. In one exemplary embodiment, the plurality of pellets 110 are constructed of plastic. However, in an alternative embodiment, the plurality of pellets 110 could be constructed of another material such as rubber, ceramic, steel, stainless steel, aluminum, or copper for example. The diameter D3 (shown in FIG. 7) of each pellet 110 is greater than size of a gap G1 (shown in FIG. 7) between the first movable retaining member 90 and the inner surface 164 of the tube 60. Further, the diameter D3 (shown in FIG. 7) of each pellet 110 is greater than size of a gap G2 (shown in FIG. 9) between the second movable retaining member 95 and the inner surface 164 of the tube 60. Thus, the first and second movable retaining members 90, 95 movably retain the plurality of pellets 110 in a portion of the interior region 166 disposed between the first and second movable retaining members 90, 95.

During operation, the size of each pellet of the plurality of pellets 110 determines a desired foam aeration level. For example, when the plurality of pellets 110 each have a relatively small diameter, the generated foam 53 has relatively high aeration level resulting in a fluffier foam 53 that is dispensed from the foam generation assembly 20. Alternately, for example when the plurality of pellets 110 each have a relatively large diameter, the generated foam 53 has a relatively low aeration level resulting in a wetter foam 53 that is dispensed from the foam generation assembly 20.

Figure 5:
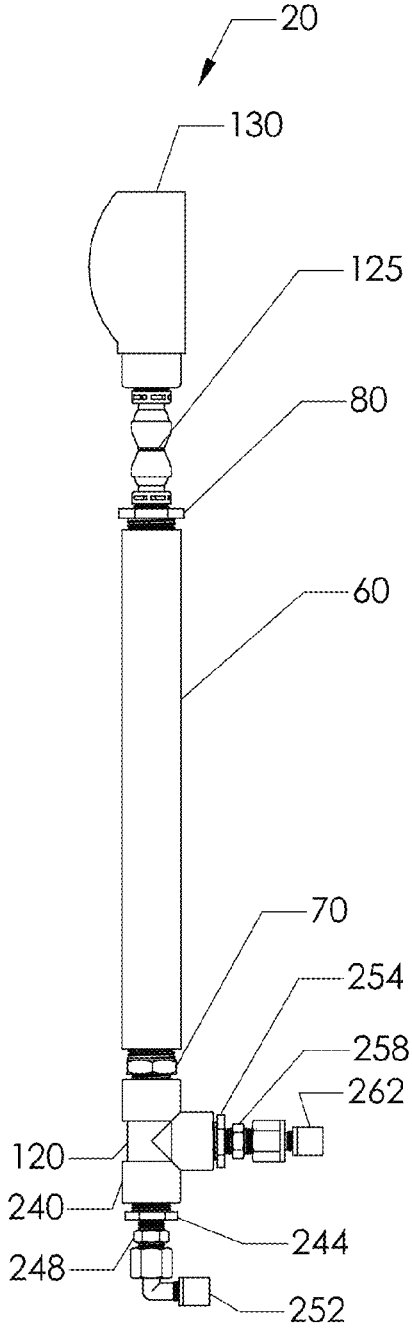
FIG. 5 is another side view of the foam generation assembly of FIG. 3.

Referring to FIGS. 1, 5 and 6, the connection assembly 120 is configured to operably and fluidly couple the first coupling member 70 to the pressurized air source 30, and the pressurized chemical solution source 50. The connection assembly 120 includes a central tee body 240, a coupling member 244, a check valve 248, a fitting member 252, a check valve 258, and a fitting member 262. The central tee body 240 includes a central body 270, and coupling portions 272, 274, 276 coupled to the central body 270 in a T-configuration. The central tee body 240 includes an internal region 280. The internal region 280 fluidly communicates with the central aperture 186 of the first coupling member 70. The coupling portion 272 defines a portion of the internal region 280 and includes internal threads 282 that are configured to threadably receive the external threads 192 of the first coupling member 70 therein. The coupling portion 274 defines a portion of the internal region 280 and includes internal threads 284 that are configured to threadably receive the external threads 316 of the coupling member 244 therein. The coupling portion 276 defines a portion of the internal region 280 and includes internal threads 286 that are configured to receive external threads 416 of the coupling member 254 therein. In an exemplary embodiment, the central tee body 240 is constructed of plastic. However, in an alternative embodiment, the central tee body 240 could be constructed of another material such as stainless steel, steel, copper, or aluminum for example.

The coupling member 244 is configured to fluidly couple the first check valve 248 to the central tee body 240. The coupling member 244 includes an end portion 310 and a body portion 312. The coupling member 244 includes a central aperture 314 extending therethrough. The end portion 310 includes external threads 316 configured to threadably engage the internal threads 284 of the central tee body 240. The body portion 312 includes internal threads 318 configured to threadably engage the external threads 390 of the check valve 248. In an exemplary embodiment, the coupling member 244 is constructed of plastic. However, in an alternative embodiment, the coupling member 244 could be constructed of another material such as stainless steel, steel, copper, or aluminum for example.

The check valve 248 is configured to allow the pressurized air 21 from the pressurized air source 30 (shown in FIG. 1) via the fitting member 252 to enter the interior region 280 of the central tee body 241 when a pressure level of the air 21 is greater than a threshold pressure level. The check valve 248 includes a first end portion 380, a second end portion 382, and a central body portion 384. The central body portion 384 is disposed between the first end portion 380 and the second end portion 382. The first end portion 380 includes external threads 390 configured to threadably engage the internal threads 318 of the coupling member 244. The second end portion 382 includes external threads 392 configured to threadably engage the internal threads 253 of the fitting member 252.

The fitting member 252 is configured to operably couple the connection assembly 122 to the pressurized air source 30. The fitting member 252 includes internal threads 253 and a central aperture 254 extending therethrough. The fitting member 252 routes the pressurized air 21 through the check valve 248 and the coupling member 244 into the internal region 280 of the central tee body 240.

The coupling member 254 is configured to fluidly couple the second check valve 258 to the central tee body 240. The coupling member 254 includes an end portion 410 and a body portion 412. The coupling member 254 includes a central aperture 414 extending therethrough. The end portion 410 includes external threads 416 configured to threadably engage the internal threads 286 of the central tee body 240. The body portion 412 includes internal threads 418 configured to threadably engage the external threads 490 of the check valve 258. In an exemplary embodiment, the coupling member 254 is constructed of plastic. However, in an alternative embodiment, the coupling member 254 could be constructed of another material such as stainless steel, steel, copper, or aluminum for example.

The check valve 258 is configured to allow a chemical solution from the pressurized chemical solution source 50, via the fitting member 262, to enter the interior region 280 of the central tee body 240 when a pressure level of the chemical solution is greater than a threshold pressure level. The check valve 258 includes a first end portion 480, a second end portion 482, and a central body portion 484. The central body portion 484 is disposed between the first end portion 480 and the second end portion 482. The first end portion 480 includes external threads 490 configured to threadably engage the internal threads 418 of the coupling member 254. The second end portion 482 includes external threads 492 configured to threadably engage the internal threads 463 of the fitting member 262.

The fitting member 262 is configured to operably couple the connection assembly 122 to the pressurized chemical solution source 50. The fitting member 262 includes internal threads 493 and a central aperture 494 extending therethrough. The fitting member 262 routes the pressurized chemical solution 51 through the check valve 258 and the coupling member 254 into the internal region 280 of the central tee body 240.

Figure 4:
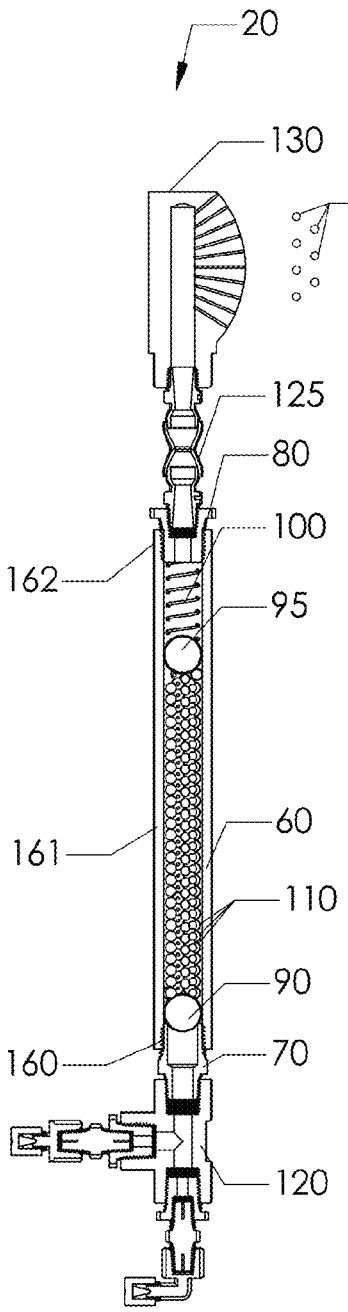
FIG. 4 is a cross-sectional view of the foam generation assembly of FIG. 3 taken along lines 4-4 having an operating state of generating a foam.
Figure 3:
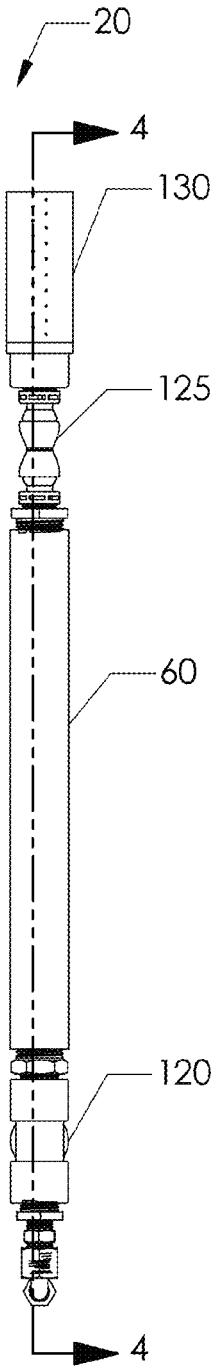
FIG. 3 is another side view of the foam generation assembly of FIG. 1.
Figure 8:
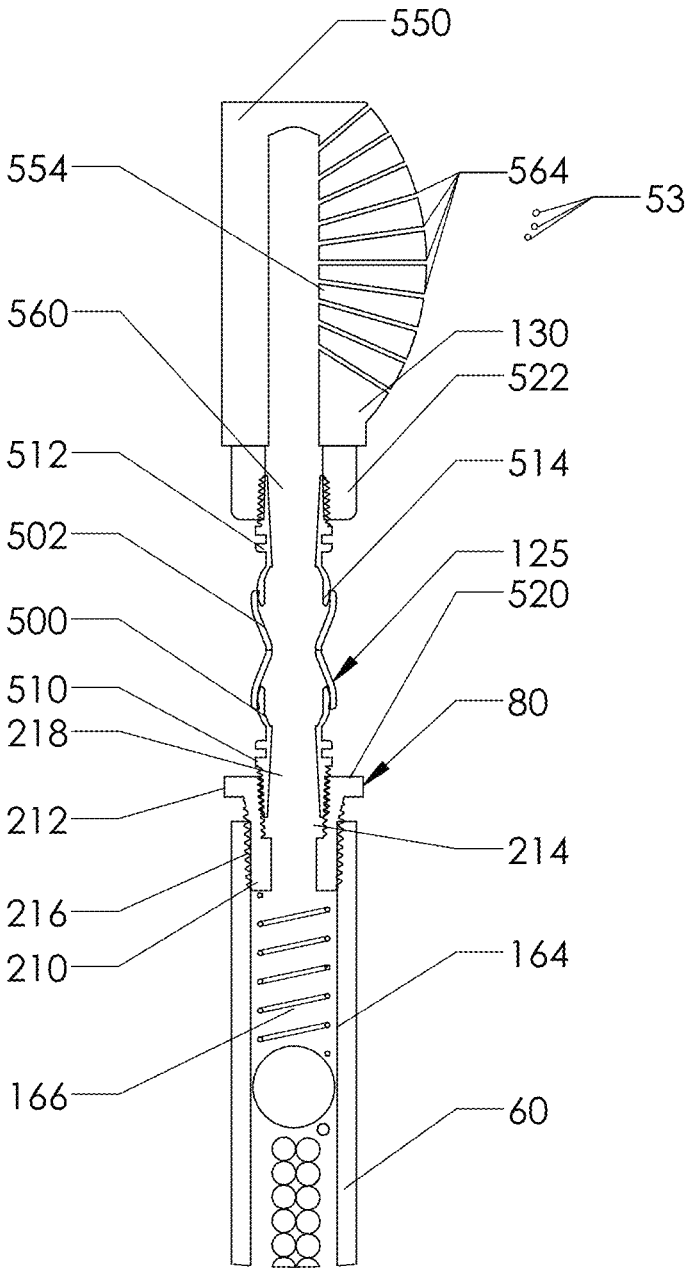
FIG. 8 is an enlarged cross-sectional view of an upper portion of the foam generation assembly of FIG. 4.
Figure 10:
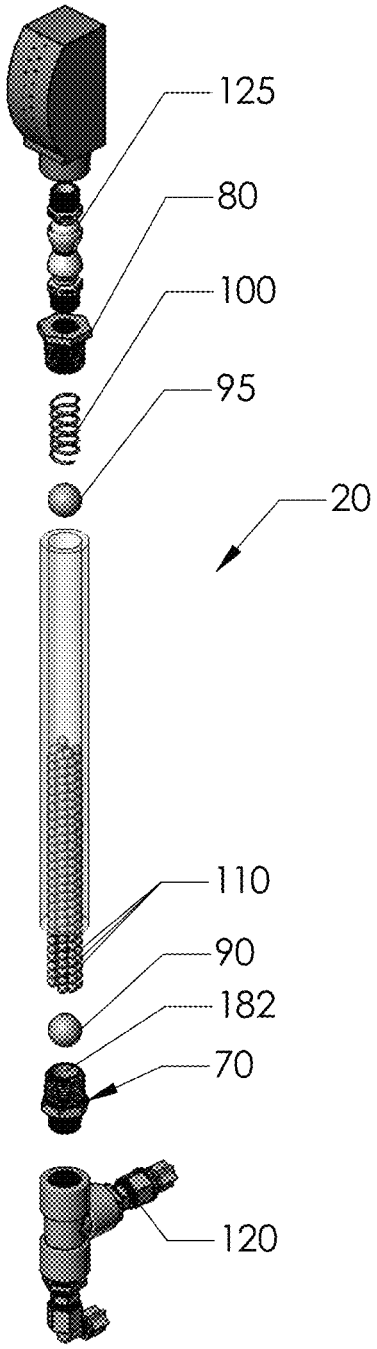
FIG. 10 is an exploded view of the foam generation system of FIG. 1.
Figure 11:
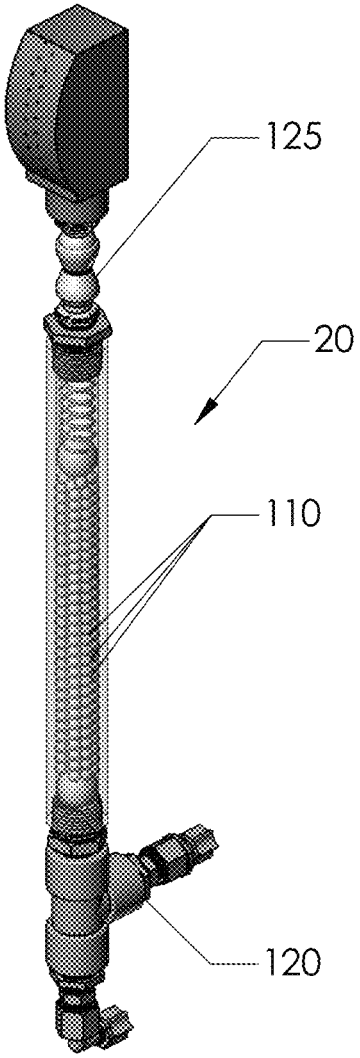
FIG. 11 is another schematic of the foam generation system of FIG. 1.
Figure 12:
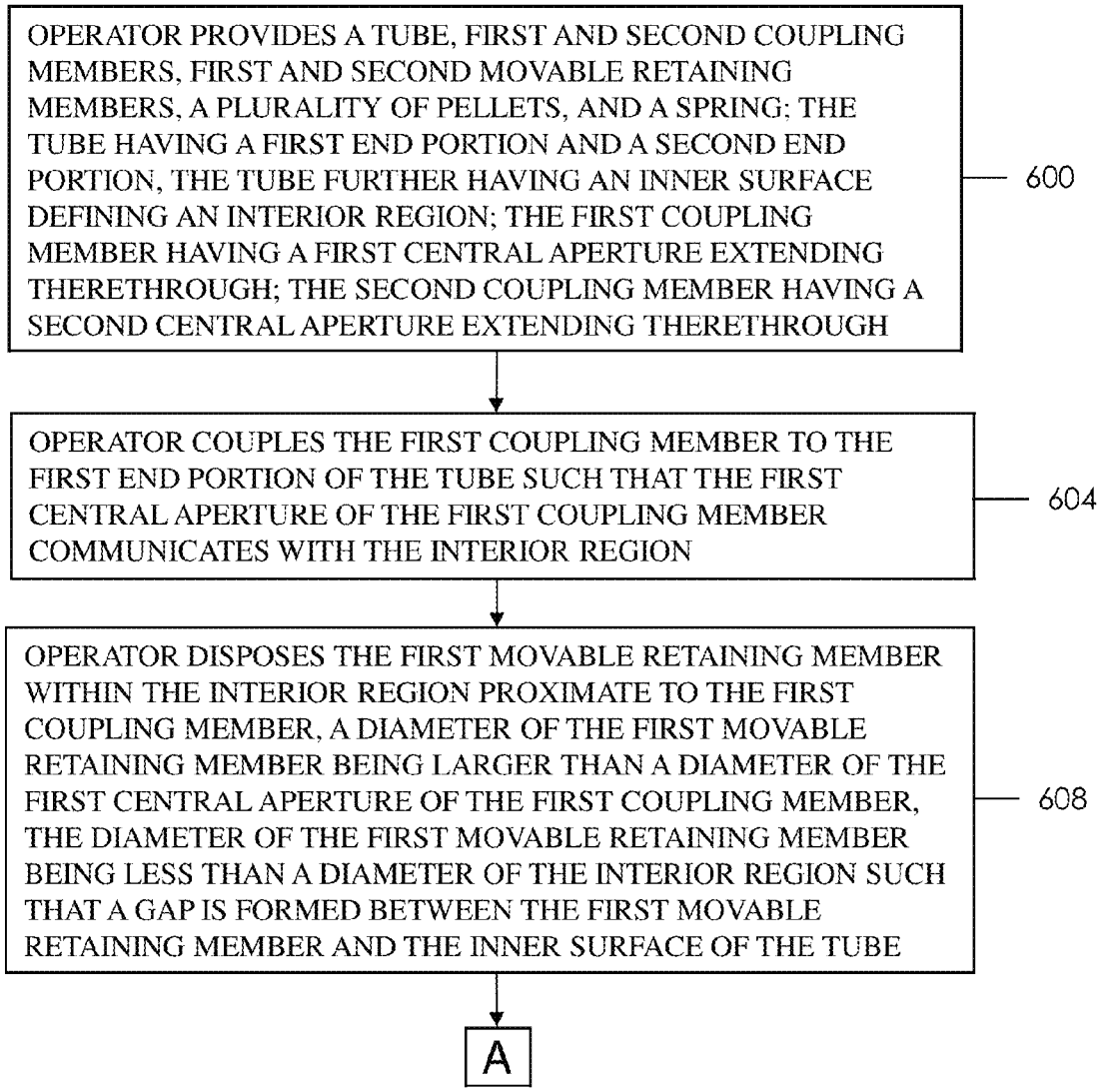
FIGS. 12-14 are a flowchart of a method for manufacturing the foam generation assembly of FIG. 1.
Figure 13:
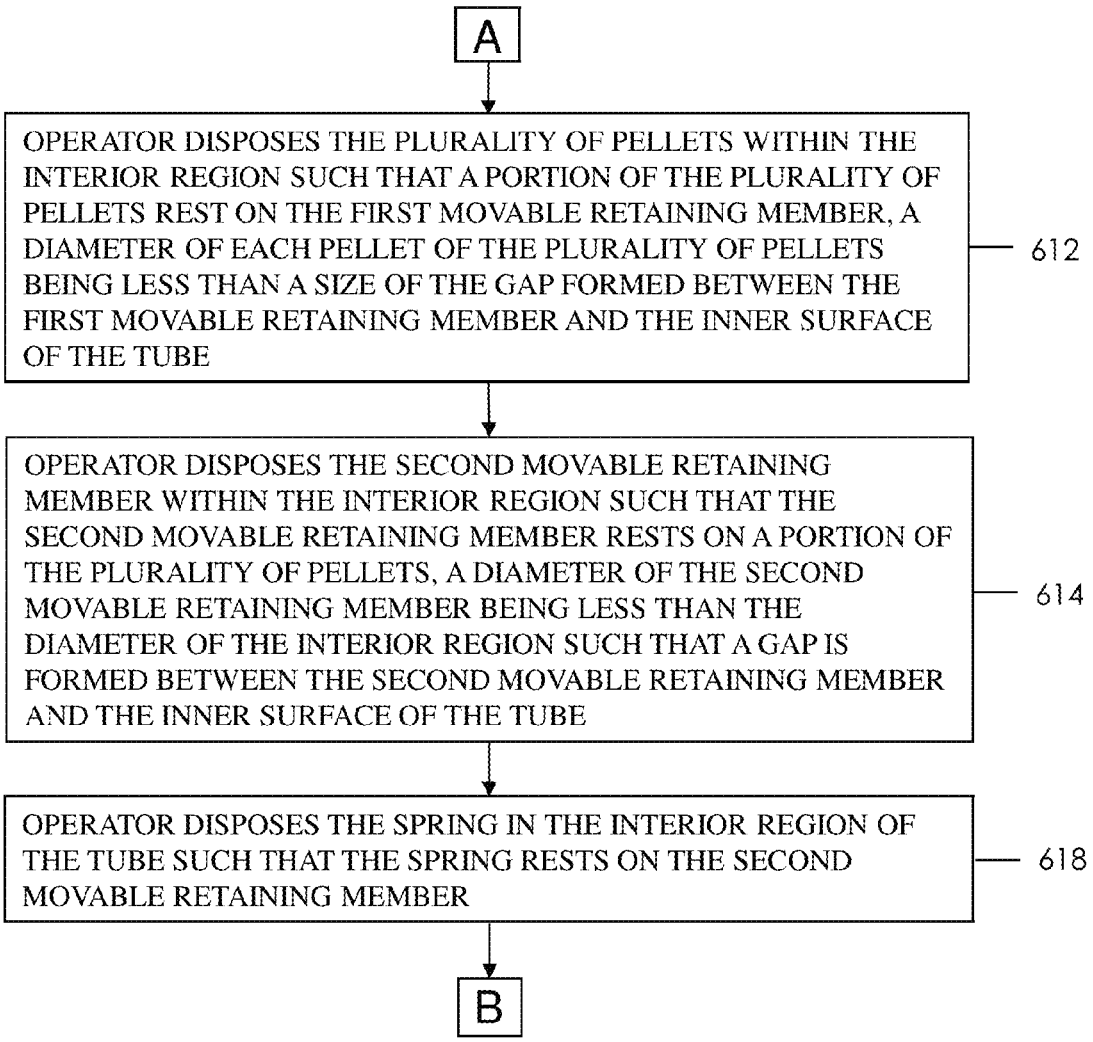
Figure 14:
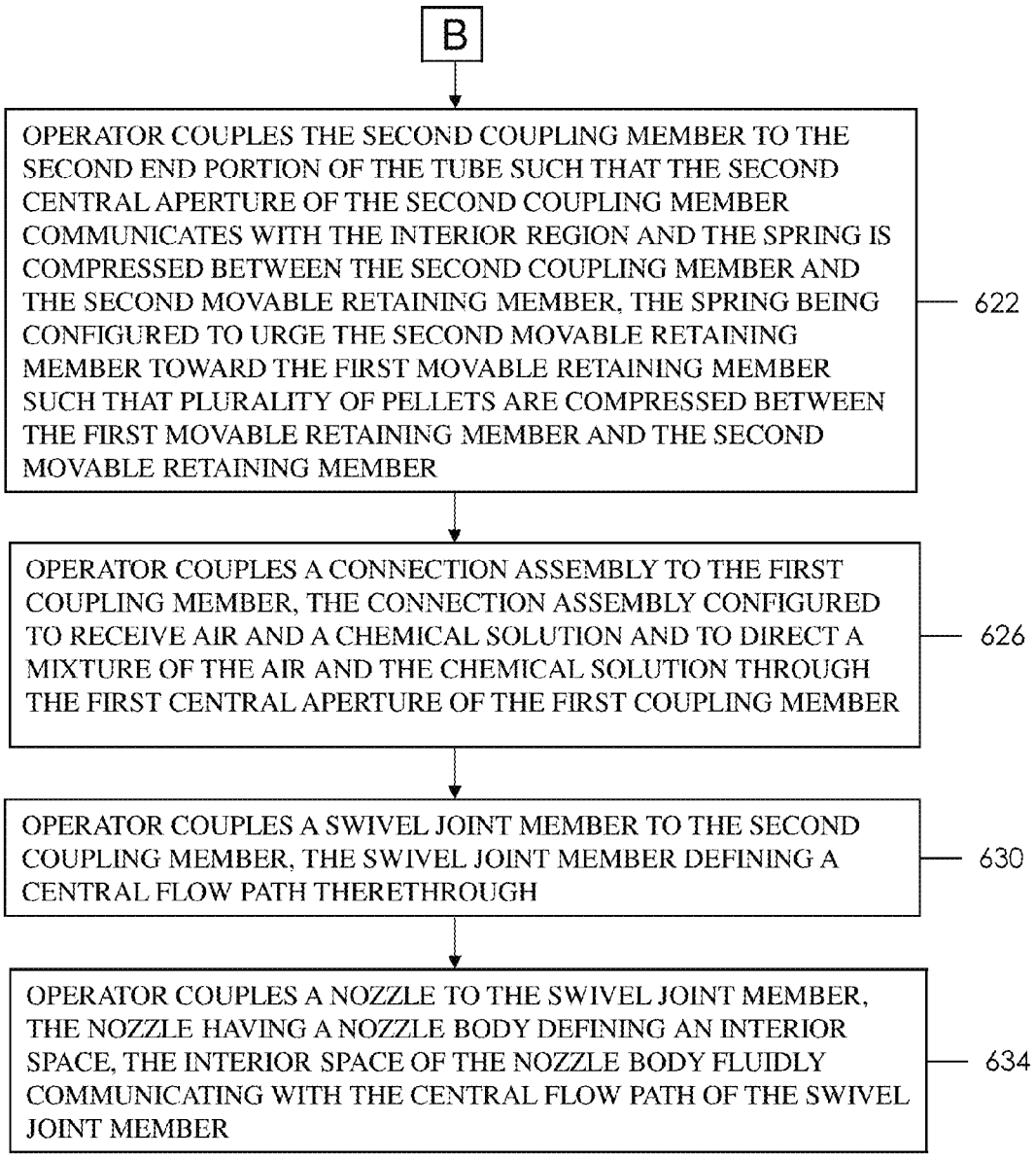

Referring to FIGS. 4 and 8, the swivel joint member 125 is configured to allow an operator to move the nozzle 130 to a desired operational position. The swivel joint member 125 is further configured to fluidly couple the interior region 166 of the tube 60 to the interior space 554 of the nozzle 130 via a central flow path 514 extending through the swivel joint member 125. The swivel joint member 125 includes a first central body portion 500, a second central body portion 502, a coupling portion 510, and a coupling portion 512. The first central body portion 500 is pivotably coupled to the second central body portion 502. The coupling portion 510 is coupled to the central body portion 500. The coupling portion 510 includes external threads 520 that threadably engage internal threads 218 of the second coupling member 80. The coupling portion 512 is coupled to the central body portion 502. The coupling portion 512 includes external threads 522 that threadably engage internal threads 560 of the nozzle 130. During operation, the swivel joint member 125 routes the foam 53 exiting the tube 60 into the interior space 554 of the nozzle 130.

The nozzle 130 is configured to receive the foam 53 from the swivel joint member 125 and to expel the foam 53 from the nozzle 130 in predetermined directions. The nozzle 130 includes a nozzle body 550 defining the interior space 554. The nozzle body 550 further includes internal threads 560 that threadably engage the external threads 522 of the swivel joint member 125. The nozzle body 550 further includes a plurality of apertures 564 extending therethrough that fluidly communicate with both the interior space 554 and an exterior of the nozzle body 550. In an exemplary embodiment, the nozzle 130 is constructed of plastic. However, in an alternative embodiment, the nozzle body 550 could be constructed of another material such as steel, stainless steel, ceramic, or aluminum for example.

Referring to FIGS. 1, 6, 7, 8, 10, and 12-14, a flowchart of a method for manufacturing the foam generation assembly 20 will now be explained.

At step 600, an operator provides the tube 60, first and second coupling members 70, 80, first and second movable retaining members 90, 95, the plurality of pellets 110, and the spring 100. The tube 60 has the first end portion 160 and the second end portion 162. The tube 60 further includes an inner surface 164 defining an interior region 166. The first coupling member 70 has the first central aperture 186 extending therethrough. The second coupling member 80 has the second central aperture 214 extending therethrough.

At step 604, the operator couples the first coupling member 70 to the first end portion 160 of the tube 60 such that the first central aperture 186 of the first coupling member 70 communicates with the interior region 166.

At step 608, the operator disposes the first movable retaining member 90 within the interior region 166 proximate to the first coupling member 70. A diameter D1 (shown in FIG. 7) of the first movable retaining member 90 is larger than a diameter D4 (shown in FIG. 7) of the first central aperture 186 of the first coupling member 70. The diameter D1 of the first movable retaining member 90 is less than a diameter D2 (shown in FIG. 7) of the interior region 166 such that a gap G1 (shown in FIG. 7) is formed between the first movable retaining member 90 and the inner surface 164 of the tube 60.

At step 612, the operator disposes the plurality of pellets 110 within the interior region 166 such that a portion of the plurality of pellets 110 rest on the first movable retaining member 90. A diameter D3 (shown in FIG. 7) of each pellet of the plurality of pellets 110 is less than a size of the gap G1 (shown in FIG. 7) formed between the first movable retaining member 90 and the inner surface 164 of the tube 60.

At step 614, the operator disposes the second movable retaining member 95 within the interior region 166 such that the second movable retaining member 95 rests on a portion of the plurality of pellets 110. A diameter D7 (shown in FIG. 9) of the second movable retaining member 95 is less than the diameter D2 (shown in FIG. 7) of the interior region 166 such that a gap G2 (shown in FIG. 9) is formed between the second movable retaining member 95 and the inner surface 164 of the tube 60.

At step 618, the operator disposes the spring 100 in the interior region 166 of the tube 60 such that the spring 100 rests on the second movable retaining member 95.

At step 622, the operator couples the second coupling member 80 to the second end portion 162 of the tube 60 such that the second central aperture 214 of the second coupling member 80 communicates with the interior region 166 and the spring 100 is compressed between the second coupling member 80 and the second movable retaining member 95. The spring 100 is configured to urge the second movable retaining member 95 toward the first movable retaining member 90 such that plurality of pellets 110 are compressed between the first movable retaining member 90 and the second movable retaining member 95.

At step 626, the operator couples the connection assembly 120 to the first coupling member 70. The connection assembly 120 is configured to receive the air 21 and the chemical solution 51 and to direct a mixture of the air 21 and the chemical solution 51 through the first central aperture 186 of the first coupling member 70.

At step 630, the operator couples the swivel joint member 125 to the second coupling member 80. The swivel joint member 125 defines a central flow path 514 therethrough.

At step 634, the operator couples the nozzle 130 to the swivel joint member 125. The nozzle 130 has the nozzle body 550 defining the interior space 554. The interior space 554 of the nozzle body 550 fluidly communicates with the central flow path 514 of the swivel joint member 125.

Figure 16:
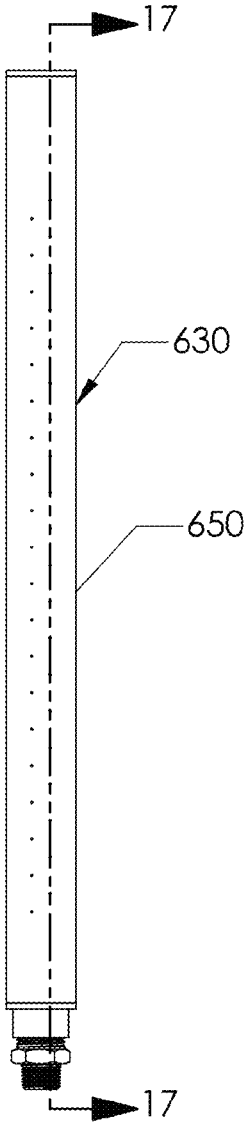
FIG. 16 is a schematic of an elongated nozzle utilized in the foam generation assembly of FIG. 15.
Figure 17:
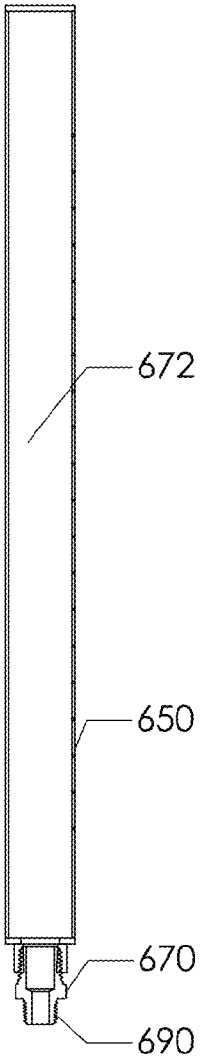
FIG. 17 is a cross-sectional schematic of the elongated nozzle of FIG. 16 taken along lines 17-17.
Figure 15:
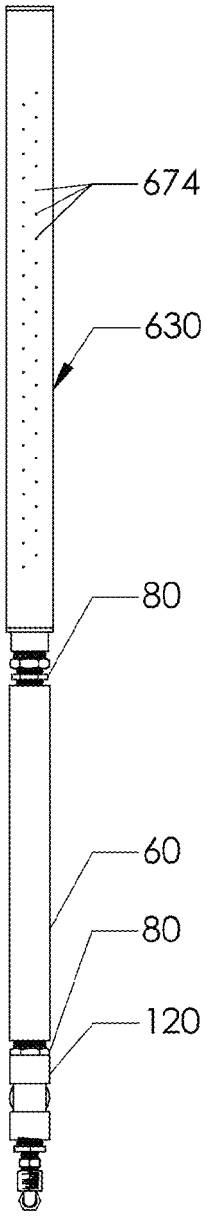
FIG. 15 is a schematic of a foam generation assembly in accordance with another exemplary embodiment.

Referring to FIGS. 15-17, a foam generation assembly 620 in accordance with another exemplary embodiment is provided. The foam generation assembly 620 utilizes all of the components of the foam generation assembly 20 except for the swivel joint member 125 and the nozzle 130. In particular, the swivel joint member 125 and the nozzle 130 are replaced with the nozzle 630.

The nozzle 630 has an elongated nozzle body 650 and a coupling member 670 disposed on an end of the nozzle body 650. The nozzle body 650 has a rectangular cross-sectional profile and defines an interior space 672. The nozzle body 650 further includes a plurality of apertures 674 extending therethrough that fluidly communicate with the interior space 672 and an exterior of the nozzle body 650. The coupling member 670 has external threads 690 configured to be received within the internal threads 218 (shown in FIG. 8) of the second coupling member 80. During operation, the nozzle 630 receives the foam 53 from the interior region 166 of the tube 60 in the interior space 554 and directs the foam 53 through the plurality of apertures 674 to an exterior of the nozzle 630. In an exemplary embodiment, the nozzle 630 is constructed of plastic. However, in an alternative embodiment, the nozzle body 630 could be constructed of another material such as steel, stainless steel, ceramic, or aluminum for example.

The foam generation assembly 20 and the method for manufacturing the assembly 20 provide a substantial advantage over other assemblies and methods. In particular, the foam generation assembly 20 and the method provide a technical effect of utilizing a plurality of pellets 110 disposed within a tube 60 for generating turbulence in a mixture flowing past the plurality of pellets 110 to generate a foam 53. A further technical effect of the foam generation assembly 20 is that the assembly 20 utilizes a spring 100 which allows the plurality of pellets 110 to move into first direction within the tube 60 when the mixture is flowing through the tube 60 such that particles lodged between at least some of the pellets 110 are released to prevent the particles from inhibiting the flow of the mixture through the tube 60. In other words, the foam generation assembly 20 allows an operator to repeatedly use the assembly 20 without having to clean the interior region or the pellets 110 of the assembly 20.

While the claimed invention has been described in detail in connection with only a limited number of embodiments, it should be readily understood that the invention is not limited to such disclosed embodiments. Rather, the claimed invention can be modified to incorporate any number of variations, alterations, substitutions or equivalent arrangements not heretofore described, but which are commensurate with the spirit and scope of the invention. Additionally, while various embodiments of the claimed invention have been described, it is to be understood that aspects of the invention may include only some of the described embodiments. Accordingly, the claimed invention is not to be seen as limited by the foregoing description.

What is claimed is:

1. A foam generation assembly, comprising:

a tube having a first end portion and a second end portion, the tube further having an inner surface defining an interior region;

a first coupling member having a first central aperture extending therethrough, the first coupling member being coupled to the first end portion such that the first central aperture communicates with the interior region;

a second coupling member having a second central aperture extending therethrough, the second coupling member being coupled to the second end portion such that the second central aperture communicates with the interior region;

a first movable spherical-shaped retaining member being disposed within the interior region proximate to the first coupling member, a diameter of the first movable spherical-shaped retaining member being larger than a diameter of the first central aperture of the first coupling member, the diameter of the first movable spherical-shaped retaining member being less than a diameter of the interior region such that a first gap is formed between the first movable spherical-shaped retaining member and the inner surface of the tube;

a spring being disposed within the interior region proximate to the second coupling member, a second movable spherical-shaped retaining member being disposed within the interior region adjacent and against the spring, a diameter of the second movable spherical-shaped retaining member being less than the diameter of the interior region such that a second gap is formed between the second movable spherical-shaped retaining member and the inner surface of the tube; and a plurality of pellets being disposed within the interior region between the first movable spherical-shaped retaining member and the second movable spherical-shaped retaining member, the spring being disposed between the second movable spherical-shaped retaining member and the second coupling member, the spring configured to compress the plurality of pellets between the first movable spherical-shaped retaining member and the second movable spherical-shaped retaining member, each of the plurality of pellets having a diameter that is less than the diameter of the first movable spherical-shaped retaining member and larger than the first and second gaps; and the first movable spherical-shaped retaining member moving away from the first coupling member in response to a mixture of air and a chemical solution flowing through the first coupling member that contacts the first movable spherical-shaped retaining member, and the first movable spherical-shaped retaining member moving the plurality of pellets in a first direction in the interior region while the plurality of pellets are held between the first and second movable spherical-shaped retaining members via the spring, and the mixture of the air and the chemical solution further flowing through the interior region of the tube and past the first gap, the plurality of pellets, and the second gap, and exits the second coupling member as a foam.

2. The foam generation assembly of claim 1, further comprising:

a swivel joint member operably coupled to and between the second coupling member and a nozzle, the swivel joint member defining a central flow path therethough that fluidly communicates with the second central aperture of the second coupling member; and the nozzle fluidly communicating with the central flow path of the swivel joint member, the nozzle having a nozzle body defining an interior space, the nozzle body further having a plurality of apertures extending therethrough, such that the foam from the second coupling member passes through the central flow path of the swivel joint member and into the interior space of the nozzle and then exits the plurality of apertures of the nozzle body.

3. The foam generation assembly of claim 1, wherein the plurality of pellets substantially fill a portion of the interior region between the first movable spherical-shaped retaining member and the second movable spherical-shaped retaining member.

4. The foam generation assembly of claim 1, wherein a size of each pellet of the plurality of pellets is greater than a size of the first gap that is formed between the first movable spherical-shaped retaining member and the inner surface of the tube.

5. The foam generation assembly of claim 1, wherein a size of each pellet of the plurality of pellets is greater than a size of the second gap that is formed between the second movable spherical-shaped retaining member and the inner surface of the tube.

6. The foam generation assembly of claim 1, wherein a size of each pellet of the plurality of pellets is less than the diameter of the first movable spherical-shaped retaining member.

7. The foam generation assembly of claim 1, further comprising a connection assembly coupled to the first coupling member, the connection assembly configured to receive the air and the chemical solution and to direct the mixture of the air and the chemical solution through the first central aperture of the first coupling member.

8. The foam generation assembly of claim 7, wherein the connection assembly includes a central body having an internal region fluidly communicating with a first check valve, the first check valve configured to receive the air to allow the air to pass therethrough into the internal region of the central body when the air has a pressure level greater than a first threshold pressure level.

9. The foam generation assembly of claim 8, wherein the connection assembly further includes a second check valve fluidly communicating with the internal region of the central body, the second check valve configured to receive the chemical solution and to allow the chemical solution to pass therethrough into the internal region of the central body when the chemical solution has a pressure level greater than a second threshold pressure level.

10. The foam generation assembly of claim 1, further comprising a nozzle fluidly communicating with the second end portion of the tube, the nozzle having a nozzle body defining an interior space, the nozzle body further having a plurality of apertures extending therethrough.

11. The foam generation assembly of claim 10, wherein the nozzle being configured to receive the foam within the interior space and to dispense the foam out of the plurality of apertures.

12. The foam generation assembly of claim 11, further comprising a swivel joint member operably coupled between the second coupling member and the nozzle, the swivel joint member defining a central flow path therethrough, such that the foam from the tube passes through the central flow path and into the interior space of the nozzle.

13. The foam generation assembly of claim 1, wherein particles lodged between the plurality of pellets are dislodged from the plurality of pellets during movement of the plurality of pellets to prevent the particles from inhibiting the flow of the mixture through the interior region of the tube.

14. The foam generation assembly of claim 1, wherein the first and second movable spherical-shaped retaining members are constructed of plastic, and the plurality of pellets are constructed of plastic.

15. The foam generation assembly of claim 1, wherein:

the first end portion of the tube having internal threads therein; and the first coupling member having a first end portion, a second end portion, and a central body portion; the central body portion being coupled to and disposed between the first and second end portions of the first coupling member; the first end portion of the first coupling member having external threads that are threadably received with the internal threads of the first end portion of the tube such that the first central aperture of the first coupling member communicates with the interior region of the tube.

16. A foam generation assembly, comprising:

a plastic tube having a first end portion and a second end portion, the plastic tube further having an inner surface defining an interior region;

a first plastic coupling member having a first central aperture extending therethrough, the first plastic coupling member being coupled to the first end portion such that the first central aperture communicates with the interior region;

a second plastic coupling member having a second central aperture extending therethrough, the second plastic coupling member being coupled to the second end portion of the plastic tube such that the second central aperture communicates with the interior region;

a first movable plastic retaining member being disposed within the interior region proximate to the first plastic coupling member, a diameter of the first movable plastic retaining member being larger than a diameter of the first central aperture of the first plastic coupling member, the diameter of the first movable plastic retaining member being less than a diameter of the interior region such that a first gap is formed between the first movable plastic retaining member and the inner surface of the plastic tube;

a spring being disposed within the interior region proximate to the second plastic coupling member;

a second movable plastic retaining member being disposed within the interior region adjacent and against the spring, a diameter of the second movable plastic retaining member being less than the diameter of the interior region such that a second gap is formed between the second movable plastic retaining member and the inner surface of the plastic tube;

a plurality of pellets being disposed within the interior region between the first movable plastic retaining member and the second movable plastic retaining member, the spring being disposed between the second movable plastic retaining member and the second plastic coupling member, the spring configured to compress the plurality of pellets between the first movable plastic retaining member and the second movable plastic retaining member, each of the plurality of pellets having a diameter that is less than the diameter of the first movable plastic retaining member and larger than the first and second gaps; and the first movable plastic retaining member moving away from the first plastic coupling member in response to a mixture of air and a chemical solution flowing through the first plastic coupling member that contacts the first movable plastic retaining member, and the first movable member moving the plurality of pellets in a first direction in the interior region while the plurality of pellets are held between the first and second movable plastic retaining members via the spring, and the mixture of the air and the chemical solution further flowing through the interior region of the plastic tube and past the first gap, the plurality of pellets, and the second gap, and exits the second plastic coupling member as a foam.

17. The foam generation assembly of claim 16, wherein the first and second movable plastic retaining members are first and second movable plastic spherical-shaped retaining members, respectively.

18. The foam generation assembly of claim 16, further comprising:

a swivel joint member operably coupled to and between the second plastic coupling member and a nozzle, the swivel joint member defining a central flow path therethrough that fluidly communicates with the second central aperture of the second plastic coupling member; and the nozzle fluidly communicating with the central flow path of the swivel joint member, the nozzle having a nozzle body defining an interior space, the nozzle body further having a plurality of apertures extending therethrough, such that the foam from the second plastic coupling member passes through the central flow path of the swivel joint member and into the interior space of the nozzle and then exits the plurality of apertures of the nozzle body.

* * * * *